US006491431B2

(12) United States Patent
Merten

(10) Patent No.: US 6,491,431 B2
(45) **Date of Patent: *Dec. 10, 2002**

(54) SANDBAG ENVELOPE

(76) Inventor: Helmut-Wolfgang Merten, Stellinger Weg 17, 20255 Hamburg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/412,073

(22) Filed: Oct. 4, 1999

(65) Prior Publication Data

US 2002/0090265 A1 Jul. 11, 2002

Related U.S. Application Data

(63) Continuation-in-part of application No. 08/601,019, filed on Feb. 16, 1996, now abandoned.

(51) Int. Cl.[7] ..... B65D 33/00
(52) U.S. Cl. ..... 383/32; 405/114
(58) Field of Search ..... 383/16, 32, 86; 405/115, 114, 111, 91, 18

(56) References Cited

U.S. PATENT DOCUMENTS

| | | | | | |
|---|---|---|---|---|---|
| 2,616,467 | A | * | 11/1952 | Cicero | 383/16 |
| 3,340,919 | A | | 9/1967 | Holbrook | |
| 3,890,802 | A | * | 6/1975 | Auriat et al. | 405/117 |
| 3,900,652 | A | | 8/1975 | Uraya et al. | |
| 3,998,304 | A | | 12/1976 | Edgerton, Jr. et al. | |
| 4,153,089 | A | * | 5/1979 | Veilleux | 383/16 X |
| 4,163,297 | A | * | 8/1979 | Neumark | 4/446 |
| 4,424,841 | A | * | 1/1984 | Smith | 224/240 |
| 4,650,368 | A | | 3/1987 | Bayer | |
| 4,736,955 | A | * | 4/1988 | Pollock | 273/336 |
| 4,963,037 | A | * | 10/1990 | Manerba | 383/16 X |
| 5,172,980 | A | | 12/1992 | Provost | |
| 5,324,042 | A | * | 6/1994 | Demas | 273/346 |
| 5,584,599 | A | * | 12/1996 | Knittel | 383/32 X |

FOREIGN PATENT DOCUMENTS

| | | |
|---|---|---|
| DE | 106906 | 3/1899 |
| DE | 697710 | 11/1962 |
| DE | 8402729 | 4/1984 |

* cited by examiner

*Primary Examiner*—Jes F. Pascua
(74) *Attorney, Agent, or Firm*—Horst M. Kasper

(57) ABSTRACT

An engaging sandbag envelope for receiving sand or another loose bulk or free-flowing medium, wherein the specific weight of the medium is higher than that of water and it does not harden during and after filling, characterised in that hook-and-loop female connecting elements are arranged on the top surface side of the sandbag envelope and hook-and-loop male sticking elements are arranged on the underneath surface side so that when the sandbag envelopes filled with a medium are stacked one upon the other and in relationship with each other the hook-and-loop male sticking elements of the one envelope engage into the hook-and-loop female connecting elements of at least one further envelope, and in that case the hook-and-loop male sticking elements and the hook-and-loop female connecting elements on the top surface side or the underneath surface side of the envelopes are arranged over the entire surface area or in portion-wise manner.

18 Claims, 9 Drawing Sheets

SANDBAG ENVELOPE

CROSS REFERENCE TO RELATED APPLICATIONS

This application is a continuation-in-part application. of another U.S. patent application filed on Feb. 16, 1996, Ser. No. 08/601,019 now abandoned. The entire disclosure of this latter application, including the drawings thereof, is hereby incorporated in this application as if fully set forth herein.

BACKGROUND OF THE INVENTION

1. Field of the Invention

The invention relates to an engaging or touch-fastening sandbag envelope for accepting a loose bulk or free-flowing medium such as sand, with no hardening during or after filling, so that a stackable constructional element results therefrom, which can be used for building up any type of protective walls.

It is common to use sacks or bags filled with sand or the like to build up protective walls, barriers against surface water, for provisional repairs of dikes, the construction of igloos and shelters and similar purposes. The disadvantage in that case is that those filled constructional elements or sacks may slip out of place when being stacked, and thus the construction of those provisional structures is hampered.

A further disadvantage with constructional elements such as for example sandbags is that upon stacking of sandbags small gaps remain between them, which make the protective construction unstable, in particular in the case of temporary high-water levels from the sea or river side and in the case of a high water level created by hurricanes, tornadoes, damage from earthquakes or dam breaks and the like, because under those conditions the water is pressed with immense pressure against the protective structure. Thus the water can pass through these gaps and issue again at the other side, which in time results in possible destruction of the protective structure. Additionally, it is important that the connection between two constructional elements or sandbags is completed within seconds, enjoys long durability and is water-tight, which is impossible with the commonly used connecting devices as they always require some time to firmly close them and in addition they are then also not water-tight.

2. State of the Art

The most relevant state of the art is to be found in U.S. Pat. No. 4,650,368. It describes a plastic container which is automatically filled with water by a suction effect when high water occurs. Those stackable plastic containers are additionally fixed on their top and bottom sides with fastener elements which are referred to as touch-and-close fastener elements or hook-and-loop fastener elements or 'Velcro' elements.

In contrast to the engaging sandbag envelopes in accordance with the present invention those water containers do not enjoy positionability which can be immediately adapted to the local conditions, in other words the water containers lack positional flexibility and positional elasticity which represent an essential property in the engaging sandbag envelopes of the invention. The lack of positional elasticity and positional flexibility in an on-site situation mean that the water container itself is not properly operational. Dangerous creepage gaps for high water immediately occur when the water containers are used to build a protective structure. Even the specified mode of fixing the water containers together with hook-and-loop fasteners remains ineffective as the water containers themselves are of a rigid nature and no longer involve engagement in relation to each other upon a minor positional displacement on site. In the event of an increase in water pressure, those water containers are directly threatened by collapse in the absence of the specific counterweight in relation to the water pressure at the side, as would be afforded for example by a filling with sand. The unfilled lightweight bags will be displaced by the pressure of the flow at a high water level during stacking. Additionally the specific weight of water-filled bags or sacks has a limited resistance to the applied water pressure at a certain level of water-pressure so that the wall becomes unstable and cannot function in the desired manner.

It is also doubtful whether the porous external surface structure for receiving water into the interior of the container functions correctly in the event of water contamination with oil or sludge or slurry because the pores of the flood water containment bags can get clogged by the pollutants and can lose their permeability so that they cannot absorb the necessary amount of water to increase in volume and weight to function as a flood water containment bag.

The water containers also lack what is known as blind layability. In a disaster situation, blind layability by virtue of sandbag envelopes using hook-and-loop fasteners is the technical standard. Due to the congruent arrangement of the hook-and-loop fastener elements on the top side and underside on the water containers, the corresponding operation of making up building construction involves a very high degree of fitting accuracy and is therefore a tedious and time-consuming operation. Since the fastener devices of that invention are in the form of narrow strips, the containers have to be stacked in a fitting manner to ensure that the strips of each bag or sack lie on a strip of another. Otherwise it would fail in establishing the desired connection between the bags or sacks.

In contrast thereto the sandbag envelopes in accordance with the invention have on the top side and the underside thereof patterns of hook-and-loop fastener elements which for example in a lattice or grid form guarantee immediate layability/stackability on site, requiring only seconds for that operation. In other words, the sandbag envelopes with their hook-and-loop fasteners can be built up on a surface at any angle in blind relationship with each other in the form of a wall-like protective structure. This is important in terms of affording protection and safeguarding life in a disaster situation.

The adhesive or cling action of the hook-and-loop fastener elements, in the operation of fixing the water containers in position, is limited only to fastening hooks but not to mushroom-shaped male sticking elements. Those mushroom-shaped male sticking elements afford an attachment or fastening action which is up 300% better, in comparison with conventional hook-and-loop fastener hooks. In the condition of being fixed in position by hook-and-loop fastening to constitute a protective wall-type structure, the sandbag envelopes equipped in that way with a hook-and-loop fastener arrangement enjoy a protective action in relation to high water, which is improved by about 300%.

A further crucial disadvantage of the water containers disclosed in U.S. Pat. No. 4,650,368 (Bayer) is that such containers are only suitable for those areas of use in which water is available for automatically filling the containers, that is to say it is essentially limited to use in affording protection in relation to a high water level.

German utility model DE-GM No 18 64 678 discloses a bag or a sack consisting of foil material. Those sacks have on their outside means which increase the friction between the filled sacks lying one on another. Those means include projections like ribs, recesses or linings and those attachment means are not suitable for forming walls or embankments, as dikes and the like, which are compact, relatively stable and water-tight.

Furthermore there are known fasteners with male and female parts consisting of hooks or mushroom-like caps and loops engaging each other, which are covered with different types of materials.

For example U.S. Pat. No. 3,900,652 (Uraya et al) discloses a velvet-type fastener, each male element of the male piece consisting of a stem and a cap laterally expanded at the top thereof and being composed of compositions of first and second polyamide polymers having different melting points. The purpose of this two-component material is to improve the strength of the connected portion between the cap and the stem of the male elements. But there is no hint at the use of those elements for bags or sacks for forming a protective wall, a dike or the like. German utility model DE-GM No 84 02 729 describes a textile areal adhesive fastener which consists of a part with hooks and a part with loops engaging each other, wherein the filaments forming the hooks and loops are covered with a thin metal layer. The purpose of this metal layer is to increase the heat resistance of the conventional adhesive fasteners so that these adhesive fasteners are usable for protective clothes, filters in heating systems or the like. These types of connection are not water-tight and are susceptible to tearing and disengaging upon the application of lateral pressure on the connected parts such as water pressure from a body of water.

Moreover, in the state of the art there are known a lot of sealing means which seal ordinary bags, sacks or the like by means of 'Velcro'-type fastening devices. See for example U.S. Pat. Nos. 3,998,304, 3,340,919 and 5,172,980 and German patent specification No 106 906. All these fasteners however are not suitable for use in sandbags for protective walls like dams, dikes, embankments and barriers against surface water, because those sandbags are exposed to very high pressures from the fluid or body of water so that the provision of sealing integrity must involve extremely firm engagement between the fastener parts, which cannot be obtained by the known sealing means. If the sandbags are used for protective walls in the case of fire or for protection against chemical substances, it is also necessary that the bags as well as the fastening and sealing devices withstand the heat of fire and chemical substances such as acids without disengagement from each other.

SUMMARY OF THE INVENTION

An object of the invention is to provide a sandbag envelope of the kind set forth above, which allows for the simple construction of protective walls, barriers of all kinds and/or wall-like provisional structures of a defined geometrical form, which are resistant to and retain sealing integrity to a high water mark at the side from the sea or river and to a high water level caused by hurricanes, tornadoes, earthquakes or dam breaks.

In accordance with the invention this object is achieved by the characterising features of claims 1 and 13. Further advantageous embodiments of the invention are described in the appendant claims.

The engaging sandbag envelope can be reliably used for all fields in which sandbags have previously been employed. They were in particular the areas of affording protection in relation to disasters and provisional structural works such as for example building igloos or shelters. In comparison with sandbags the hook-and-loop fastener-equipped sandbag enclosures according to the invention however have the advantage that they can be stacked like bricks which stick to one another. In comparison with the traditional sandbag system this affords a 20 to 30-fold improvement in protection thanks to the increase in adhesion strength. Handling of the sandbag envelopes according to the invention is simple even for untrained people. An advantage in this respect is the ease of handling of the sandbag enclosures in a disaster situation by virtue of fastening-specific patterns on the top side and underside of the sandbag envelopes which are to be fastened by the hook-and-loop fastening means. Those patterns are such that they constitute a blind-laying system which makes it possible in seconds to implement the beginning of a protective structural configuration. By means of this pattern system, the most widely varying construction systems can be extremely simply and easily produced, set up and dismantled again and transported to and from the location of employment.

The material components of the hook-and-loop female connecting elements and the hook-and-loop male elements or sticking elements advantageously comprise plastic alloys, plastic and metal or metal or metal alloys, as well as non-ferrous metal. The surfaces of the hook-and-loop connections can additionally be covered with a thin coating, for example by vapor deposition or otherwise. In that respect the coating can be heat-resistant and acid-resistant and comprise plastic or plastic alloys, plastic and metal or metal, metal alloys or specific alloys of non-ferrous metals. It is likewise desirable for only the outside surfaces of the envelopes or those of mat webs to be provided with the above-mentioned material coatings. The fastener-specific lattice or grid patterns or diagonal loop patterns form in a configuration on an envelope or on a mat web about 20 to 30 interengaging hook-and-loop connecting points. Those hook-and-loop fastening points which are distributed in a lattice or grid over an area of about 0.4 square meters have an adhesion capability of between about 250 and 400 kilograms in relation to lateral shearing forces. That adhesion capability is advantageously increased by the use of mesh metal or by the coating of mesh metal or the use of mushroom-shaped hook-and-loop male fastening elements comprising plastic material or metal.

This therefore affords a wide range of mutually interchangeable material properties, this applying in regard to all existing plastic materials, metals and non-ferrous metals. If for example steel hook-and-loop sticking or male elements or steel hook-and-loop female connecting elements are coated with the non-ferrous metal aluminum, then both those elements have the material property of steel in regard to the physical forces which occur such as pressure or shearing force, but in terms of surface adhesion (in engagement) the material properties are those of aluminum. It is also to be noted that metal hook-and-loop male and female connecting elements adhere to each other about 10-fold better than conventional plastic hook-and-loop fastening elements or normal hook-and-loop fastening elements and in that respect they are also fire-resistant and acid-resistant. In addition surface adhesion is increased due to metal mesh which is in the form of a mushroom-shaped or mushroom head-shaped attachment element. In comparison with plastic hook-and-loop hooks, the mushroom-shaped or mushroom head-shaped attachment elements which are made from plastic material have a material connection adhesion effect which is between 200% and 300% higher.

The sandbag envelope can comprise carbon fiber fabric in order to ensure a high temperature resistance. It is also possible to produce the sandbag envelopes from anti-rot UV-resistant synthetic fibers such as for example polyacryl or another-plastic fabric or natural fabric. An envelope in the form of a plastic sheet or foil material is also desirable, in which case that fabric can be reinforced.

The top side and the underside of each sandbag envelope can be marked with the letters O and U respectively, which are preferably fluorescent. Thus the letters are identifiable on the sandbag envelopes even in darkness. This ensures secure stacking and construction of interengaging sandbag envelopes, even in darkness.

It is desirable for the hook-and-loop male or sticking elements and the hook-and-loop female or connecting elements on the top side or the underside of the engaging envelopes also to be fluorescent. Hook-and-loop sticking elements and hook-and-loop connecting elements are provided to form the hook-and-loop fastenings. The hook-and-loop sticking elements can be in the form of hooks or mushroom heads and the hook-and-loop connecting elements can be in the form of fleece, fleece loops or fleece felt, velvet or warp-knitted loop or pile velvet.

They are non-releasably connected to the engaging sandbag envelope for example by sticking, sewing, hot welding or ultrasonic welding. Their size depends on the respective area of application. For example, engaging sandbag envelopes of extremely large dimensions may be used for protection against storm tides or for protecting a steep embankment. The surface patterns of the hook-and-loop male sticking elements and female connecting elements respectively may vary. It is possible to have diagonal patterns in strip form, diagonal patterns in serpentine form, lattice or grid patterns or circular patterns. Those surface patterns are interchangeable with each other for the felt and hook surfaces. Those surface patterns can also be used for double-sided hook and fleece mats as well as for hook and fleece strips. Those mats can have at both sides either hook-and-loop sticking elements or hook-and-loop connecting elements. It is also possible for those mats to have hook-and-loop sticking elements on the top side and hook-and-loop connecting elements on the underside. They may however also have hook-and-loop sticking elements and hook-and-loop connecting elements on the top side and hook-and-loop connecting elements and hook-and-loop sticking elements on the underside. With the features referred to hereinbefore as being in accordance with the invention, for the hook-and-loop materials and the kinds of fabric involved, these features are also suitable for a design configuration of the double-sided engaging mats or engaging mat webs. The function of those areal double-sided engaging mats or double-sided engaging mat webs is for them to function in a similar manner to a layer of mortar between bricks. These engaging mat webs can be used in the most widely varying lengths and widths. This element can additionally in the longitudinal direction connect the envelopes for example of a protective wall in engagement with each other, thereby increasing the loading stability of building structures, for example that of dike protective walls to resist high water at one side thereof or frontal wave pressure at the side towards the sea. The engaging mat webs serve for the construction of protective walls and also as structural positional foundations for the engaging sandbag envelopes. In that respect they may be arranged lengthwise, in a stepped form, in an upward direction or in a downward direction, in engaging relationship with the fleece-type or engaging sandbag envelopes. In that way the engaging mat webs are a necessary supplemental structural element for stabilisation of the envelopes. The above-mentioned engaging mats or engaging mat webs would without the envelopes have no function.

The above-outlined engaging mat webs are therefore also suitable for affording supplemental stabilisation in regard to the areas of use which are also set out hereinafter for the engaging sandbag envelopes.

The engaging sandbag envelopes are suitable for example for:

- the construction of protective walls for dike defense purposes at high water, storm tides or with a high water level at the side towards sea or river,
- construction of temporary homes and shelters in disaster areas, for example in an igloo style,
- construction of temporary bridge pillars or bridges of viaduct type; sturdy support of buildings threatening to collapse after an earthquake,
- construction of protective walls to afford protection from high wind speeds and high water levels which occur for example with hurricanes and tornadoes, and
- the erection of protective walls in relation to large fires by means of incombustible sandbags.

They can also be used for safeguarding tunnels in mines by affording sturdy supports. A special design configuration of the invention provides that the engaging sandbag envelopes can also be in the form of a triangular, acid-resistant hose system for stemming chemicals which have escaped or contaminated extinguishing water in fire-fighting uses and so forth. Further possible uses of the sandbag envelope involve for example preventing loads from slipping when being transported on ships, aircraft, trucks and other transport systems (for example railway).

For the purposes of constructing a protective wall-type system, the sandbags are filled either until they are tight or to an extent such that they are not tight. Non-tight filling affords the advantage of positional. stackability of the engaging sandbag envelopes to form building structures. That is to say the engaging sandbags which are not filled to the extent of being tight but which are therefore slack can assume virtually any geometrical shape in the stacked condition, when considered from the point of view of cross-section. In that respect no sandbag in the strictly technical sense is the same in terms of its geometrical cross-sectional shape as any other, and smaller or greater deviations in terms of volume and configuration are the standard here.

The combination of slack filling of the engaging sandbag envelopes with the hook-and-loop fastening elements-specific blind laying system permits optimum flexible and elastic inherent statics in relation to pressure forces occurring at the side from the exterior, in the case of hurricanes, storm tides, explosion or bombardment. A building structure of that kind can equalise the frontal pressure or flow or hydraulic pressure, for example when a high water level occurs, with the optimum flexibility and elasticity, while the hook-and-loop elements on the envelopes in engaging relationship with each other can react flexibly to different flow or hydraulic forces and pressure forces. In other words the structure adapts itself to the hydrodynamic pressure forces in respect of inherent statics and post-stabilisation capability. The stability of a protective wall-like structure is advantageously increased by the structure being formed in individual honeycombs in the longitudinal direction. The individual honeycombs are filled in their free central surface area for example with a medium comprising sand or gravel. That affords a higher level of stability in relation to storm and flood waves.

A further advantageous embodiment of the engaging sandbag envelopes with features according to the invention provides that the operation of filling an envelope is implemented by means of a plurality of small envelopes filled with material. These small or miniature envelopes can be of the most widely varying shapes and sizes for filling purposes, the, shape and size of the miniature envelopes being determined in dependence on the nature of the constructional use of the sandbag envelopes. Accordingly they are preferably filled with sand or a loose bulk or free-flowing medium which does not harden, and in that respect they can be selectively connected together by a line, cord or,another form of connection. In the event of bombardment or when sharp-edged propellent material is involved, this sandbag envelope can thus admittedly be damaged, but as a component of a building structure it does not loose its function as for example only one or two of a plurality of miniature envelopes are damaged or destroyed. This kind of functional construction has a remote similarity to the safety bulkheads in the hull of a ship to resist penetration of water into the hull due to sudden leaks. Conventional envelopes in contrast suffer a loss of their structural function due to the contents being washed out or water seeping in, therefore that kind of protection from seepage or washing-out in the case of engaging sandbag envelopes is of significance in regard to erecting protective walls and other building structures and the static load-bearing capability thereof. In this connection conventional sandbags can also be filled in the above-indicated configuration. It is likewise desirable for the miniature envelopes to be of a fleece configuration in part or over the whole of their area, on their outside surface, by virtue of a fleece fabric.

In a further advantageous configuration, the hook-and-loop sticking elements on the surface side and the hook-and-loop connecting elements on the surface side of the envelope can be interchanged. The interchange is effected by virtue of hook-and-loop connecting elements over part of the surface area or the whole thereof, in orderly patterns, in the form of adhesive strips or pattern-perforated adhesive surface foils, wherein the pattern-perforated adhesive surface foils are either sticky on one side or are sticky on both sides at their surface and in that respect non-releasably adhere directly to the envelope itself and/or form an engagement with the outside surface of at least one envelope. Likewise it is possible for self-welding adhesive connecting elements to be mounted to envelopes over part or the entire surface area thereof. The above-mentioned features according to the invention relating to the arrestable surface patterns and so forth apply in regard to all kinds of adhesive connections referred to herein.

With the above-mentioned features in accordance with the invention relating to the kinds of fabric and fillings it is possible in a further configuration according to the invention to use tubular envelopes on site. In this case, a plurality of tubular envelopes are laid in mutually juxtaposed relationship on site in a longitudinal row. Those tubular envelopes can be plaited or braided or woven manually or by machine like over-sized yarns in the longitudinal direction, in which case the result is an areal geometrical plaiting or weave. The structure of the surface in that case is more or less lumpy and bumpy and can advantageously be used for positional securing purposes for the next layer of the plaited or braided or woven tubular envelopes. The envelope material should therefore be flexible or elastic and should involve a predetermined longitudinal or serpentine form. In a situation involving stacking layer upon layer, that kind of woven layer array consisting of tubular envelopes can be additionally arrested in position on both sides with a double-sided hook-and-loop fastening hook mat web. That therefore affords the structure an increased level of composite strength when confronted with relatively heavy swell or so-called tsunamis which occur after seaquakes. Advantageously, the tubular envelopes can be bound together by cord at both ends and extended manually or by machine by being suitably tied to other tubular envelopes.

Due to the high level of stability of the sandbag envelopes in comparison with the known sandbags, the amount to be transported for the respective area of use is often reduced. That decreases the costs for storage. Thus the procurement costs for an amount of sandbag envelopes for protection and safeguarding purposes is lower than the procurement costs for adequate amounts of conventional sandbags.

BRIEF DESCRIPTION OF THE DRAWINGS

The invention is further described hereinafter by way of example of envelopes according to the invention with reference to the accompanying drawings.

DESCRIPTION OF THE PREFERRED EMBODIMENTS

Figure 2:
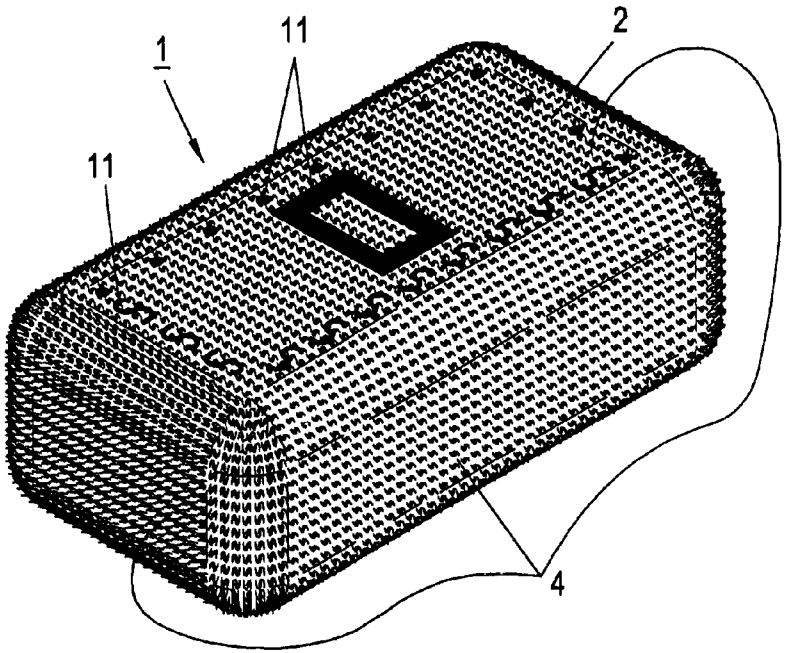
FIGS. 1 and 2 show two perspective views of a filled engaging sandbag envelope.
Figure 1:
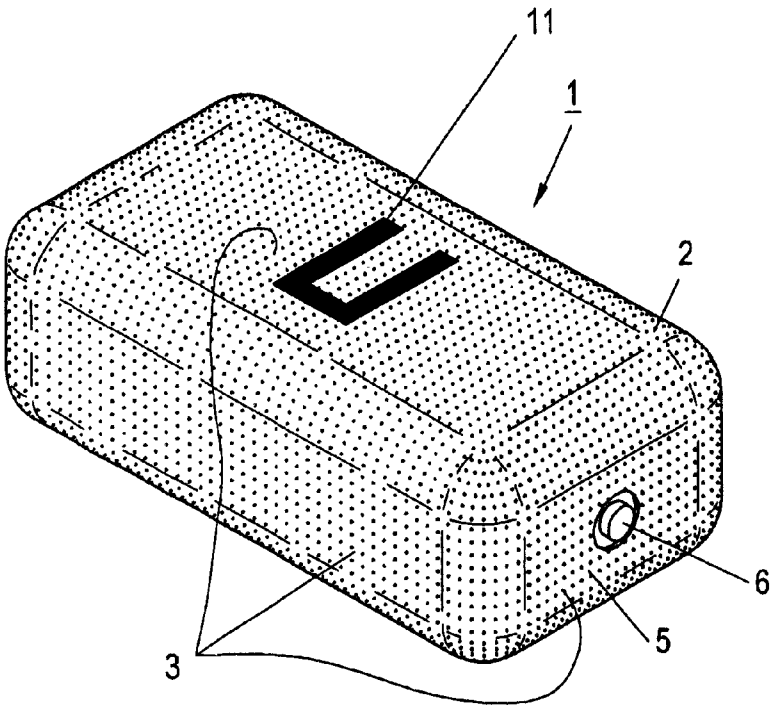
Figure 2A:
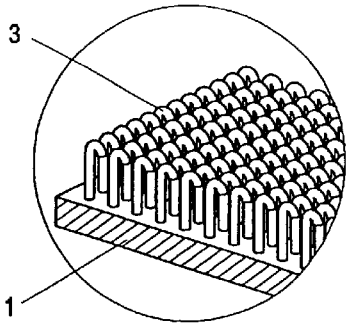
FIGS. 2*a* and 2*b* show perspective views of two possible shapes of hood-and loop sticking (male) elements.
Figure 2B:
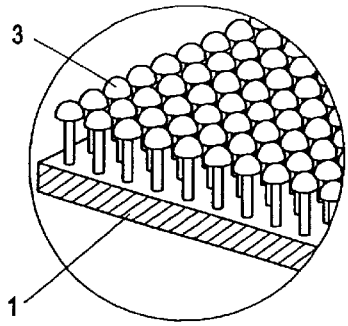
Figure 2C:
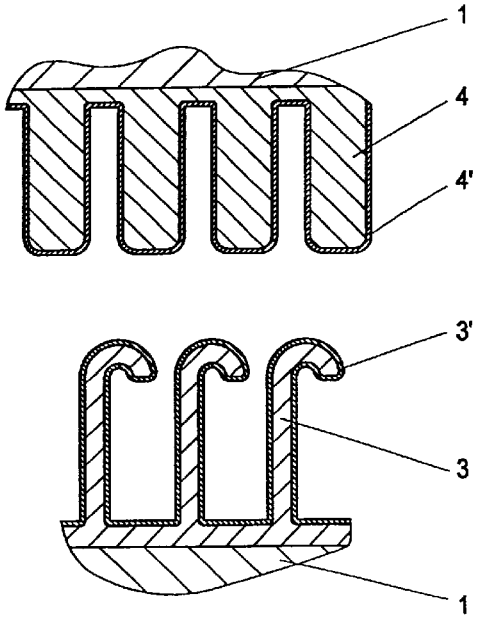
FIGS. 2*c* and 2*d* show male sticking elements with respective thin and partially thin coatings.
Figure 2D:
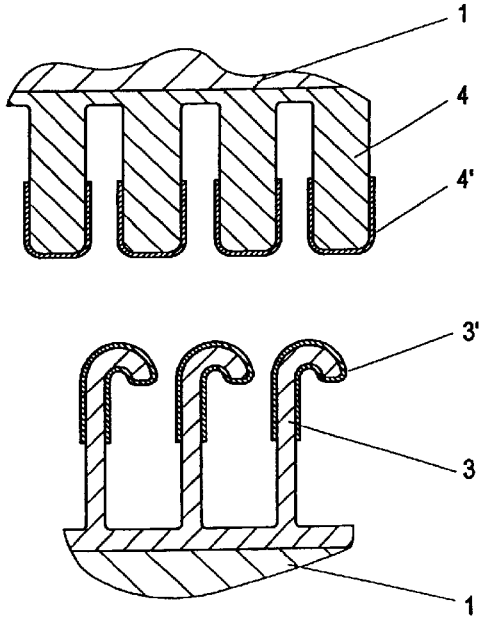
Figure 3:
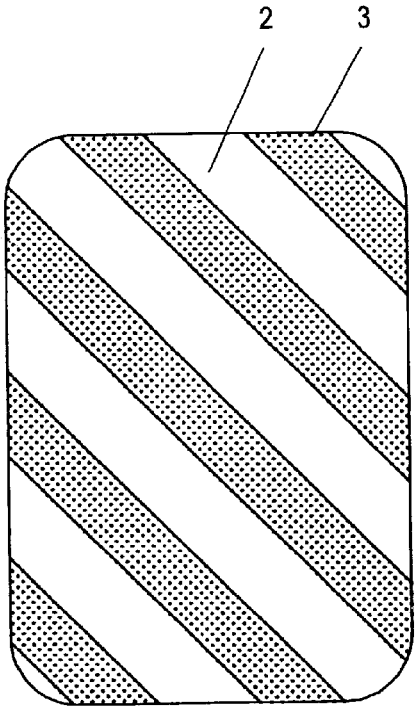
FIGS. 3 through 11 show examples for the arrangement of hook-and-loop connecting elements or hook-and-loop sticking elements on the surfaces at the top side or the underside of the sandbag envelopes, wherein these show some blind-laying systems in pattern form.
Figure 4:
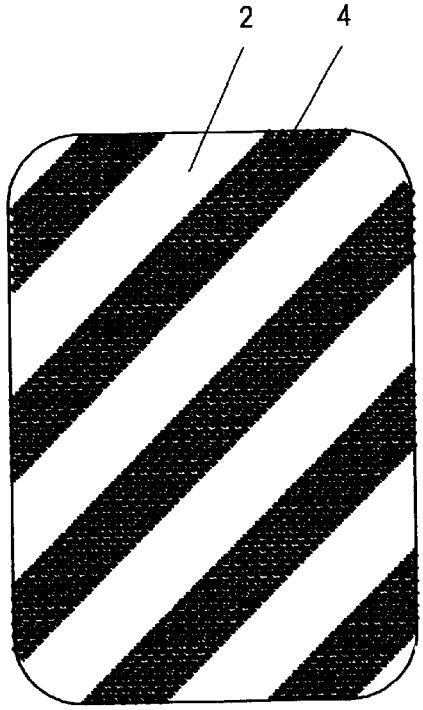
Figure 5:
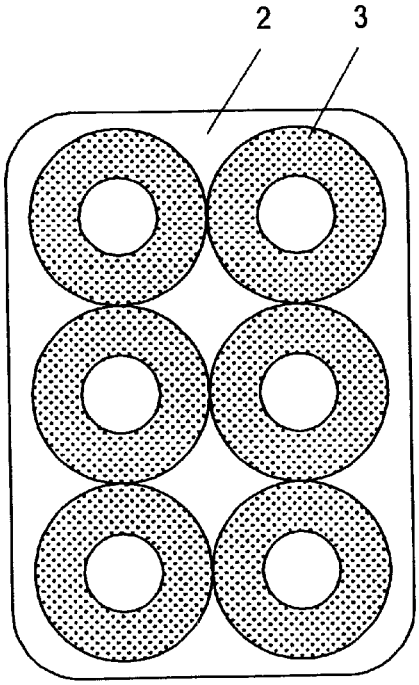
Figure 6:
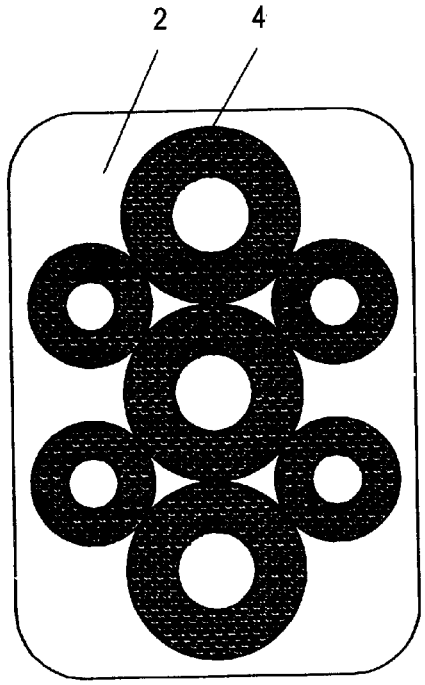

The engaging envelope 1 shown in FIGS. 1 and 2 is of a cuboidal configuration after having been filled with a medium (not shown). There is a seal 6 at a front surface 5, through which the medium such as for example sand or water has been introduced into the engaging envelope 1. Three mutually abutting surfaces of the envelope 1 are provided with hook-and-loop hooks 3 (FIG. 1) which form the hook-and-loop sticking elements or male elements 21.

They can also be in the form of mushroom heads. The further three abutting surfaces of the envelope 1 are coated with hook-and-loop fastening felt or loop felt 4 (FIG. 2), forming the hook-and-loop connecting elements or female elements 20. Thus, when piling up the envelopes 1 which are filled with the medium, it is possible to connect one respective exterior surface 2 which is provided with hooks 3 of the one envelope 1 to the exterior surface 2 which is provided with hook-and-loop felt or loop felt 4 of a further envelope 1. This connection makes it possible to pile up the individual envelopes 1 which are filled with a medium one upon the other in such a way that on the one hand sideways dislodgement of individual filled envelopes 1 is prevented and on the other hand liquids are prevented from passing therethrough. The hook-and-loop hooks 3 and the hook-and-loop felt or loop felt 4. can comprise metal including non-ferrous metal, plastic material or natural fibers.

The envelope 1 can also be provided with hook-and-loop sticking elements or male elements on both sides or hook-and-loop connecting or female elements on both sides, while the top side and the underside can be provided with hook-and-loop sticking or male elements and hook-and-loop connecting or female elements.

The hook-and-loop felt or loop felt 4 can be arranged over the entire area on the exterior surfaces 2 in question. It is however also possible for the hook-and-loop felt or loop felt 4 to be provided only a portion-wise or point-wise manner. Thus the hook-and-loop felt or loop felt 4 can be provided for example in strip form or point form, diagonally in crossed relationship or in a wave configuration on the respective exterior surface 2 of the envelope 1.

Examples in this respect are shown in FIGS. 3 through 11. The hook-and-loop sticking or male elements and the hook-and-loop connecting or female elements are so positioned on the envelope 1 that there is always an engagement when stacking envelopes 1.

It is desirable for the top and bottom exterior surfaces 2 of each envelope 1 to be provided with surface-specific symbols 11, as is diagrammatically shown in FIGS. 1 and 2. The symbols O and U respectively identify the respective top side and underside of an envelope 1. The further surface-specific symbols 11 which are illustrated in point form or in serpentine form mark the exterior surfaces 2 which have hook-and-loop hooks 3 or hook-and-loop felt or loop felt 4 respectively. In that way, when setting up an assembly of envelopes 1, the exterior surfaces which are to be respectively brought into engagement with each other, of the envelopes 1, can be easily associated with each other.

Figure 7:
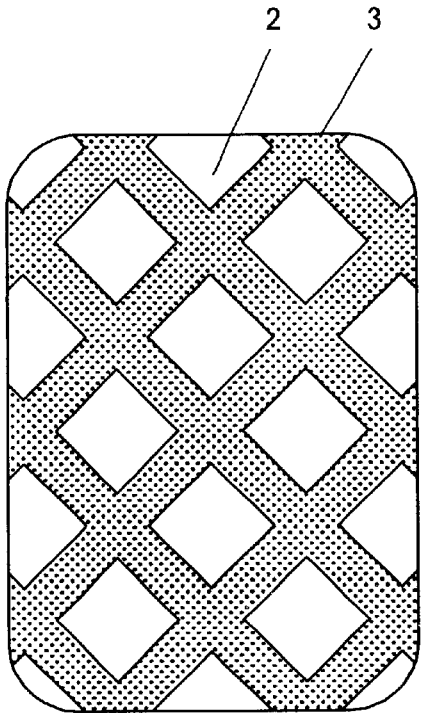
Figure 8:
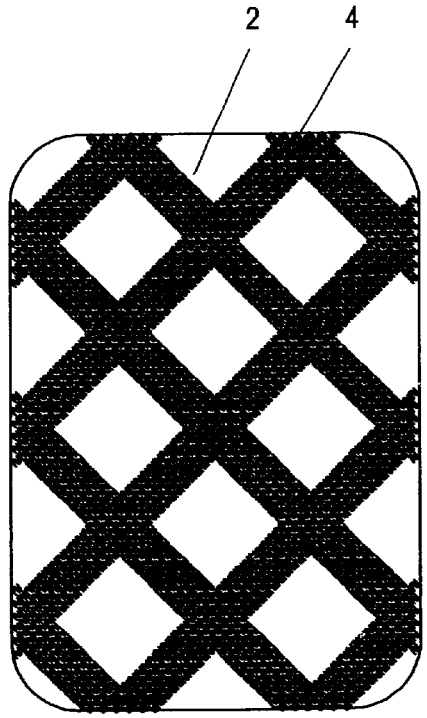
Figure 9:
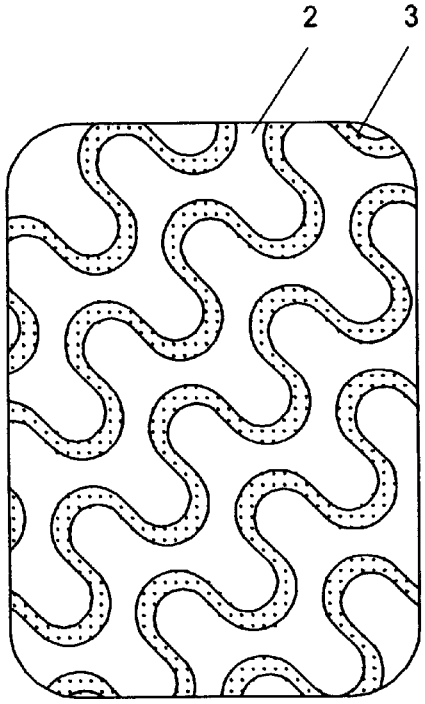
Figure 10:
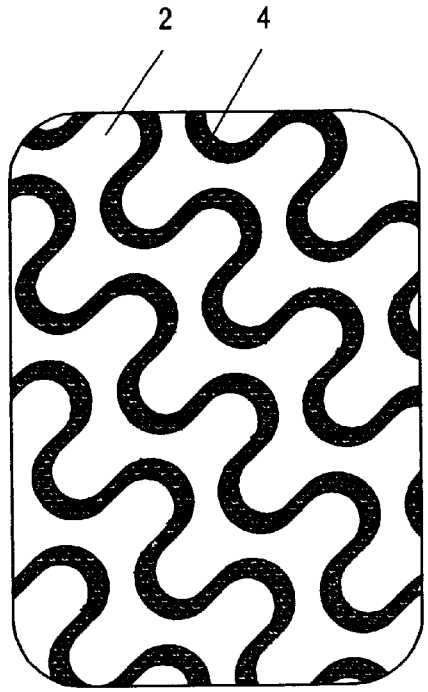
Figure 11:
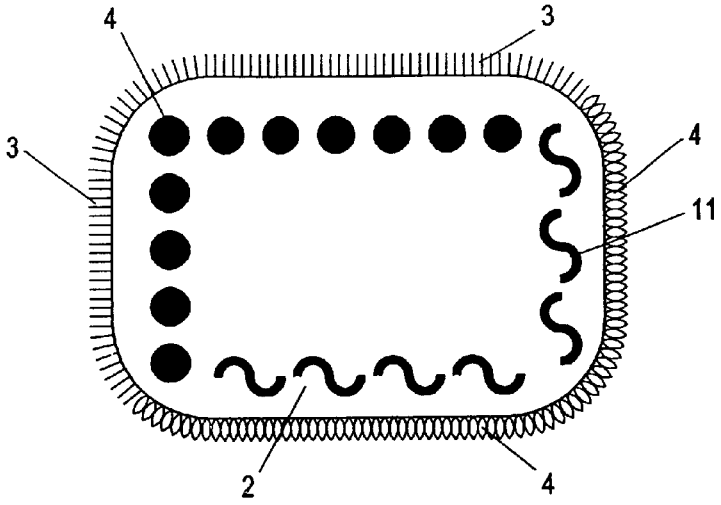

The different hook-and-loop fastener patterns in FIGS. 3 through 10 each form a respective blind-laying system, the blind-laying system patterns in FIGS. 7 and 8 in the form of grid patterns and in FIGS. 9 and 10 in the form of diagonal serpentine patterns being particularly effective. In such a configuration an envelope 1 or a double-sided hook-and-loop mat web 7 can be laid in the surface in any desired angle relative to the assembly, that is to say there is no dead hook-and-loop angle in the interengaging condition to constitute a building structure.

Figure 12:
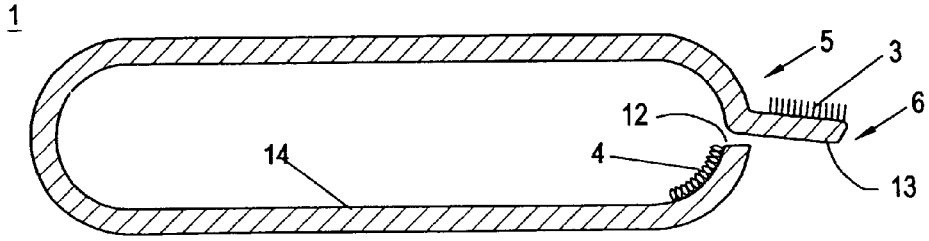
FIGS. 12 through 14 show a sandbag envelope in two cross-sectional views and in a plan view.
Figure 13:
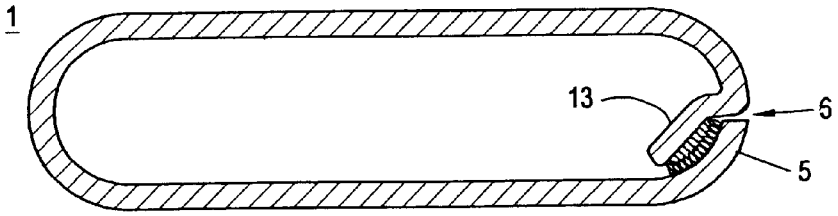
Figure 14:
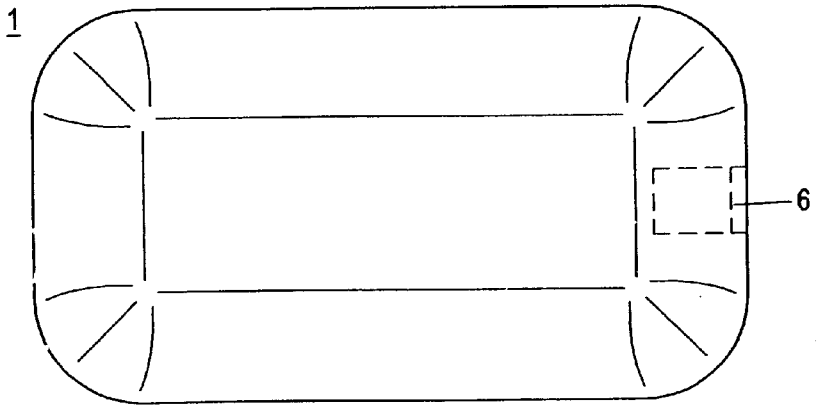

FIGS. 12 through 14 show the configuration of a seal 6 of an envelope 1. An opening 12 is provided in the one front surface 5 of the envelope 1. The width of the opening 12 can be larger or smaller. Formed to the opening 12 is a first tab 13, on the exterior surface of which are arranged hook-and-loop sticking or male elements 1 such as hook-and-loop hooks 3. or hook-and-loop mushroom heads 3. In addition a second tab 13 is arranged and formed at the opening 12 in opposite relationship to the first tab 13. Arranged on the second tab 13 on the exterior. surface are hook-and-loop connecting or female elements 20 and hook-and-loop fleece 4 or velvet 4. When the opening 12 is closed both tabs 13 are folded into the interior of the envelope, in which case the hook-and-loop elements 20 arranged on the exterior surfaces of the two tabs 13 come into engagement with each other and form the seal 6. That seal 6 is suitable for hopper filling manually or by machine. In the filled condition of the envelope 1 the medium filled therein bears against the two tabs 13 whereby the seal 6 has an optimum resistance to pressure and can no longer open by itself.

Figure 15:
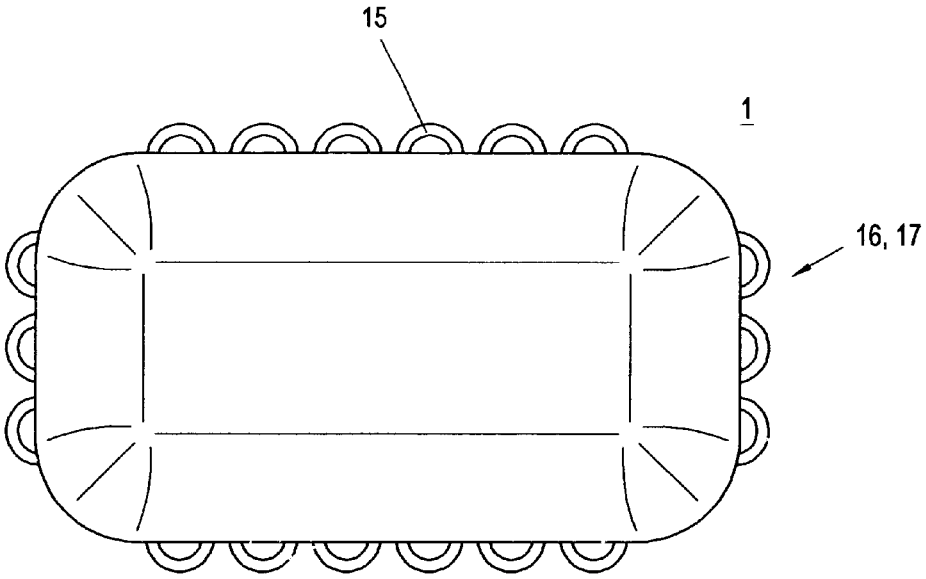
FIG. 15 is a plan view of a further example of a sandbag envelope.
Figure 16:
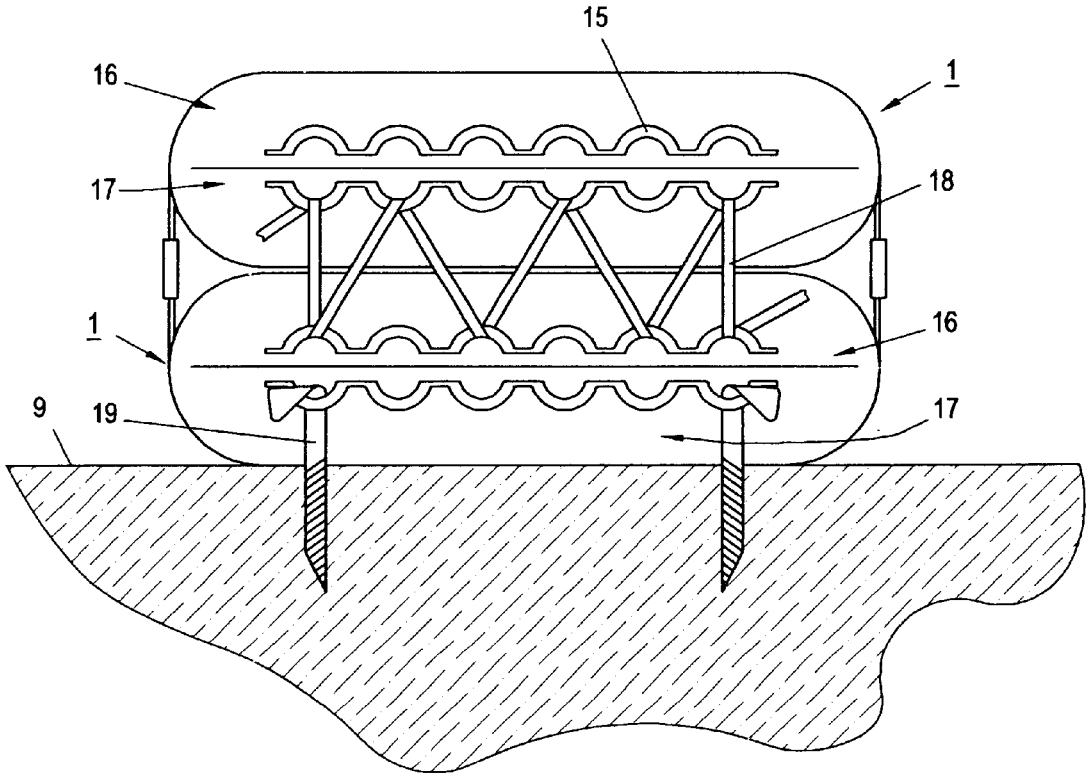
FIGS. 16 through 19 show diagrammatic side views of examples for the use of engaging sandbag envelopes.

It is also possible to attach loops 15 running along the sides of the envelope 1, see FIG. 15. Preferably the loops 15 are arranged as an upper loop strap 16 and a lower loop strap 17, see FIG. 16. The lateral loops 15 of the envelope 1 are to perform the function of anchoring the envelope 1 to the ground surface 9 by means of ground anchors 19 and thus safely fasten it in position. For that purpose the ground anchors 19 which are firmly anchored in the ground surface 9 are firmly connected to the loops 15 of the loop straps 16 and 17 by means of a rope or cable 18.

A further function of the lateral loops 15 is to be able to firmly tie or connect an engaging envelope 1 or a non-engaging envelope to another engaging envelope 1 or non-engaging envelope, by means of a rope or cable 18. In that way the envelopes are kept in a stable position in which they can be piled up. By means of anchors let into the ground surface 9, pivotable fixing devices or rings can be let into the ground surface 9 in order should the need arise to be able to fix the engaging envelopes 1 to them.

Figure 17:
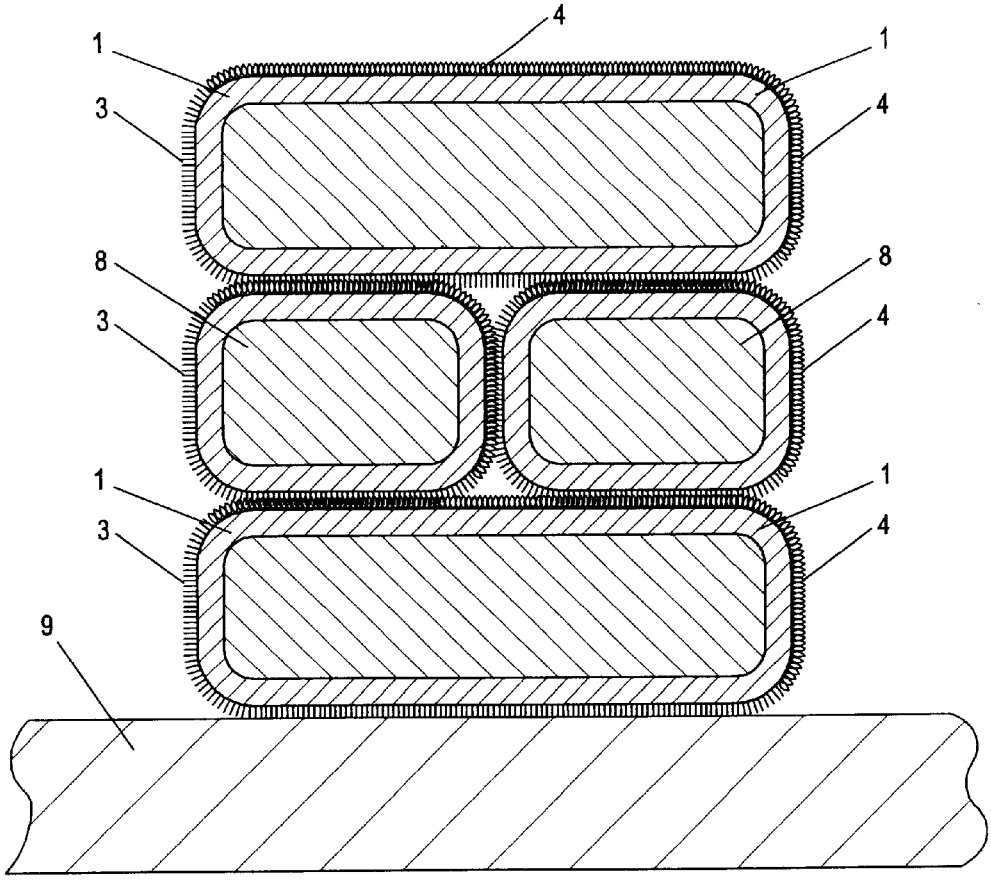

Insofar as engaging envelopes of different cross-sections are involved, they can also be piled up to form an assembly after filling them with a medium. That is especially advantageous if for example a piece of land 9 is to be protected against water arriving from one side. FIG. 17 shows an example of a protective wall of that kind.

Figure 18:
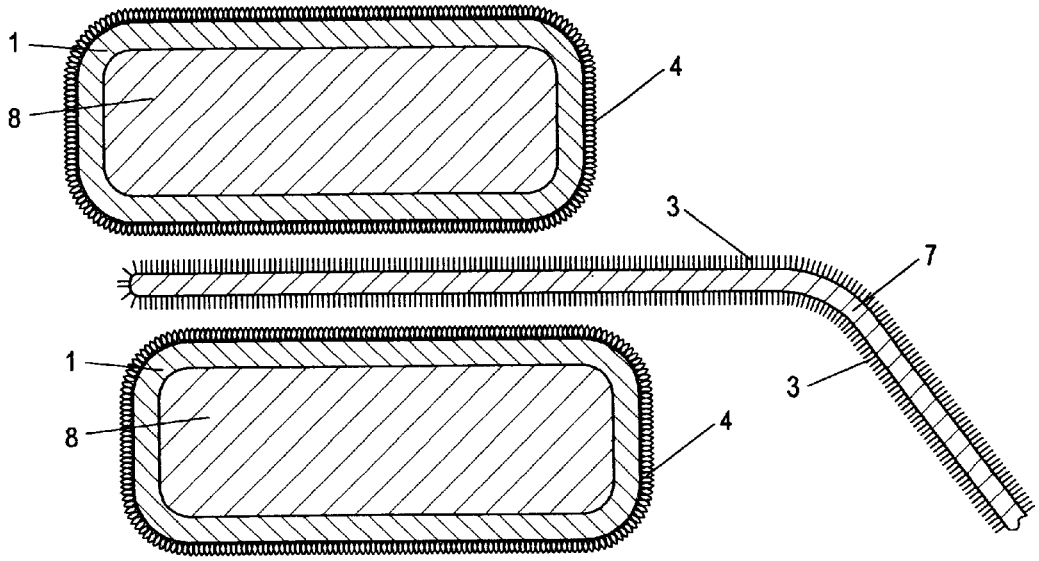

It is also possible for the entire exterior surface 2 of the engaging envelopes 1 to be provided with hook-and-loop hooks 3 or hook-and-loop felt or loop felt 4 respectively. In this case, when piling up the engaging envelopes 1 which are filled with a medium 8, a mat 7 must be arranged between them, the mat 7 being provided on both sides with hook-and-loop felt or loop felt 4 or however with hook-and-loop loops 3 (see FIG. 18). The mat 7 can have hook-and-loop sticking or male elements on the top side and hook-and-loop connecting or female elements on the underside. The mat 7 may also be provided with hook-and-loop sticking or male elements and hook-and-loop female elements on the top side and also on the underside. Therefore the mat 7 is referred to either as a double-sided hook-and-loop sticking or connecting element mat 7 or a hook-and-loop sticking or male mat web or webs 7, or a double-sided hook-and-loop connecting or female. element mat 7 or a hook-and loop connecting or female element mat web or webs 7. They can also be provided only on one surface with the hook-and-loop elements,for forming foundations for engaging sandbag envelopes.

Figure 19:
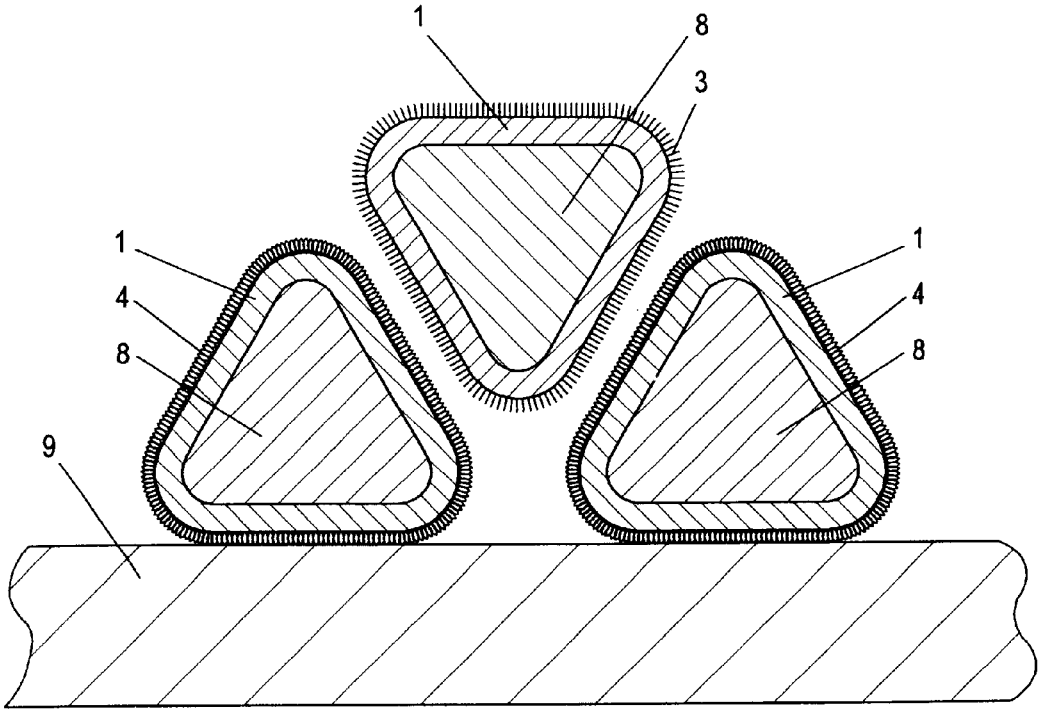
Figure 19A:
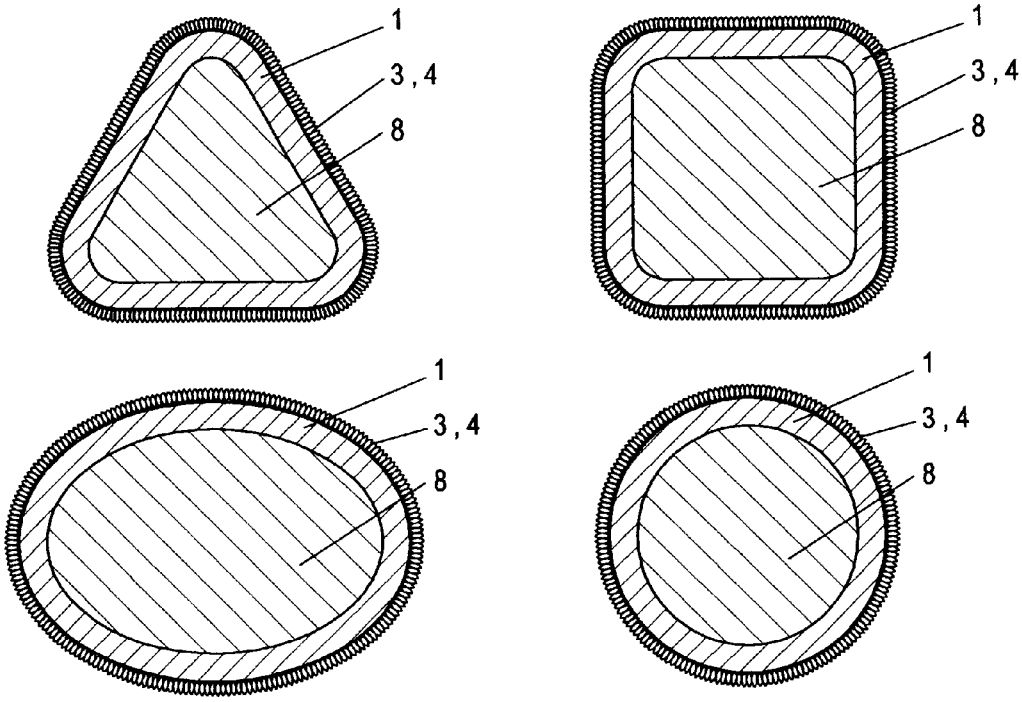
FIG. 19*a* shows cross-sectional views of different sandbag envelopes filled with a medium.

FIG. 19 shows engaging envelopes 1 which can be in the form of tubes or hoses and which can be used for example as a provisional barrier against spreading liquid or chemicals. These envelopes 1 are generally of a triangular cross-section in the condition in which they are filled with medium. The exterior surfaces are alternately provided over their entire surface area with hook-and-loop hooks or hook-and-loop felt or loop felt 4 so that the envelopes 1, upon being stacked one upon the other, are connected together in mutually sealed relationship.

Figure 20:
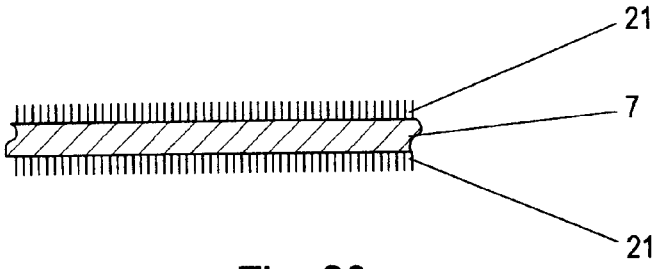
FIG. 20 shows a portion of the mat of FIG. 18 with hook-and-loop male or sticking elements on the top side and the underside.
Figure 21:
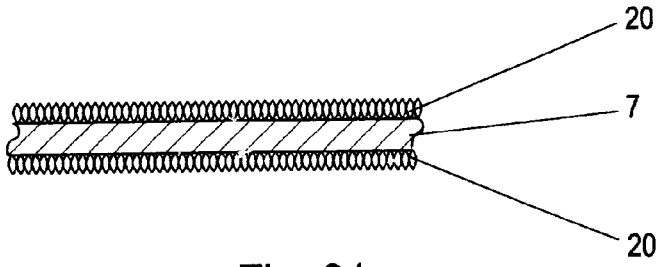
FIG. 21 shows a portion of the mat shown in FIG. 18 with hook-and-loop female or connecting elements on the top side and the underside.
Figure 22:
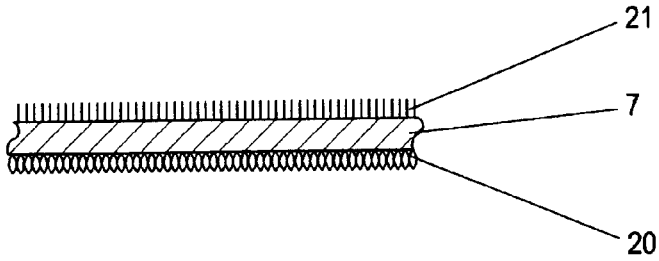
FIG. 22 shows a portion of the mat of FIG. 18 with hook-and-loop sticking elements on the top side and with hook-and-loop connecting elements on the underside.
Figure 23:
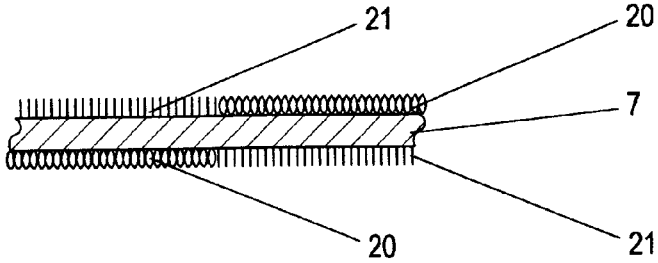
FIG. 23 shows a portion of the mat of FIG. 18 with hook-and-loop sticking elements and hook-and-loop connecting elements on the top side and with hook-and-loop connecting elements and hook-and-loop sticking elements on the underside.

FIGS. 20 through 23 show different embodiments of the mat 7 which, when the envelopes 1 filled with a medium 8 are stacked one upon the other, is arranged between them and which results in improved stability of a structural work consisting of engaging envelopes 1 under extreme conditions, such as for example at high water, when dealing with whirlwinds or storm floods, in conditions of extreme cold with ice floe formation or the like. The mat 7 can be of a different configuration, as is shown in FIGS. 20 through 23. FIG. 20 shows a mat 7 which carries hook-and-loop sticking or male elements 21 on the top side and the underside. FIG. 21 shows a mat 7 which carries hook-and-loop connecting or female elements 20 on the top side and the underside while FIG. 22 shows a mat 7 which carries hook-and-loop sticking or male elements 21 on the top side and hook-and-loop connecting or female elements 20 on the underside. Finally, FIG. 23 shows a particular embodiment of the mat 7 in which the mat 7 has hook-and-loop sticking or male elements 21 and hook-and-loop connecting or female elements 20 on the top side and hook-and-loop connecting or female elements 20 and hook-and-loop sticking or male elements 23 on the underside, wherein the elements are always arranged alternately in strips or other patterns on the top side and the underside.

What is claimed is:

1. A structural construction comprising a mat having a top side and having a bottom side, wherein the top side of the mat is covered with a first member selected from the group consisting of hook-and-loop male sticking elements and hook-and-loop female connecting elements, and wherein the bottom side of the mat is covered with a second member selected from the group consisting of hook-and-loop male sticking elements and hook-and-loop female connecting elements;

an envelope having a top side and having a bottom side, wherein the top side of the envelope is covered with a third member selected from the group consisting of hook-and-loop male sticking elements and hook-and-loop female connecting elements and different from the second member, and wherein the bottom side of the envelope is covered with a fourth member selected from the group consisting of hook-and-loop male sticking elements and hook-and-loop female connecting elements and different from the first member.

2. The structural construction according to claim 1, wherein the top of the mat engages the bottom of the envelope.

3. The structural construction according to claim 2 further comprising a second mat having a top side and having a bottom side, wherein the top side of the second mat is covered with the first member and wherein the bottom side of the second mat is covered with the second member and wherein the bottom of the second mat engages the top of the envelope.

4. The structural construction according to claim 2 further comprising a second envelope having a top side and having a bottom side, wherein the top side of the second envelope is covered with the third member and wherein the bottom side of the second envelope is covered with the fourth member and wherein the top of the second envelope engages the bottom of the mat.

5. The structural construction in accordance with claim 1, in which hook-and-loop male sticking elements and, hook-and-loop female connecting elements consist of material selected from the group consisting of metal, non ferrous metal, plastic and natural fibers.

6. The structural construction in accordance with claim 5, in which hook-and-loop male sticking elements and hook-and-loop female connecting elements are covered by a complete thin coating selected from the group consisting of plastic material and non ferrous metal alloy.

7. The structural construction in accordance with claim 5, in which the hook-and-loop male sticking elements and the hook-and-loop female connecting elements are covered by a partial thin coating selected from the group consisting of plastic material and non-ferrous metal alloy.

8. The structural construction in accordance with claim 1, in which the envelope (1) is made of a material from the group consisting of a carbon fiber fabric and a fabric of UV-resistant synthetic fiber.

9. The structural construction in accordance with claim 1, in which the male sticking elements are formed as mushroom heads and the female connecting elements are made of a material selected from the group consisting of hook-and-loop type felt, felt loops and fleece, fleece loops, fleece felt fabric.

10. The structural construction in accordance with claim 1, in which the cross-section of the envelope (1), filled with a medium (8), is of any geometrical shape selected from the group of round, square, rectangular, generally triangular and oval shapes.

11. The structural construction in accordance with claim 1, in which several envelopes (1) filled with a medium (8) and engaged with one another in a row and stack by the mats (7) form a stable barrier resistant to lateral approach of water.

12. The structural construction in accordance with claim 1, wherein the hook-and-loop female connecting elements and hook-and-loop male sticking elements are disposed according to a member of the group consisting of the entire surface area, part of the surface area, in the form of diagonal patterns, in strip form, in the form of diagonal wave patterns, in a serpentine form, in the form of a grid pattern, in circular from and in point form.

13. The structural construction in accordance with claim 1, wherein the filled engaging envelopes (1) are formed sack shaped.

14. The structural construction in accordance with claim 1, wherein the filled engaging envelopes (1) are formed tubular shaped.

15. The structural construction in accordance with claim 1, in which several envelopes (1) filled with a medium (8) and engaged with one another in a row and stack by the mats (7) form a building system.

16. The structural construction in accordance with claim 1, in which several envelopes (1) filled with a medium (8) and engaged with one another in a row and stack by the mats (7) form a temporary shelter.

17. The structural construction in accordance with claim 1, in which several envelopes (1) filled with a medium (8) and engaged with one another in a row and stack by the mats (7) form a sturdy support of buildings threatened with collapse.

18. The structural construction in accordance with claim 1, in which several envelopes (1) filled with a medium (8) and engaged with one another in a row and stack by the mats (7) form protective walls.

* * * * *